US006059444A

United States Patent [19]

Johnson et al.

[11] Patent Number: 6,059,444

[45] Date of Patent: May 9, 2000

[54] APPARATUS FOR MIXING CALCINED GYPSUM AND ITS METHOD OF OPERATION

[75] Inventors: Steven Burdett Johnson, Elsinore; Charles Allen Whittington, Monroe; Lyle Dee Fullmer, Elsinore, all of Utah

[73] Assignee: United States Gypsum Company, Chicago, Ill.

[21] Appl. No.: 09/014,680

[22] Filed: Jan. 28, 1998

[51] Int. Cl.[7] ..... B01F 15/02; B01F 5/04

[52] U.S. Cl. ..... 366/172.2; 366/172.1; 366/304

[58] Field of Search ..... 366/3, 10, 13, 366/30, 34, 172.2, 167.1, 181.8, 64, 65, 168.1, 172.1, 303, 304

[56] References Cited

U.S. PATENT DOCUMENTS

| | | | |
|---|---|---|---|
| 2,464,523 | 3/1949 | Muench | 259/10 |
| 2,538,891 | 1/1951 | Zimmerman et al. | 259/10 |
| 2,660,416 | 11/1953 | Camp et al. | 259/178 |
| 2,805,051 | 9/1957 | Miller | 259/154 |
| 3,459,620 | 8/1969 | McCleary et al. | 156/346 |
| 4,155,657 | 5/1979 | King et al. | 366/172.1 |
| 4,194,925 | 3/1980 | Holbrook et al. | 134/24 |
| 4,402,615 | 9/1983 | Mayer | 366/65 |
| 4,768,534 | 9/1988 | Anderson | 134/175 |
| 4,904,089 | 2/1990 | Dunton et al. | 366/6 |
| 4,995,729 | 2/1991 | Eberhardt et al. | 366/2 |
| 5,376,175 | 12/1994 | Long, Jr. et al. | 118/303 |
| 5,484,200 | 1/1996 | Bradshaw | 366/15 |
| 5,580,170 | 12/1996 | Holley et al. | 366/325.1 |
| 5,683,635 | 11/1997 | Sucech et al. | 264/42 |
| 5,772,318 | 6/1998 | Vadnais | 366/64 |

*Primary Examiner*—W. L. Walker
*Assistant Examiner*—Terry K. Cecil
*Attorney, Agent, or Firm*—Robert H. Robinson; John M. Lorenzen

[57] ABSTRACT

This invention provides a method and apparatus for mixing calcined gypsum. The invention comprises a mixer which employs high pressure water to eliminate or substantially reduce the formation of lumps of gypsum inside the mixer which cause paper breaks when the calcined gypsum slurry containing the lumps is used to form the gypsum core in a gypsum wallboard product. High pressure water jets direct a spray of high pressure water at the surfaces within the mixer where the lumps of gypsum are formed. The method of this invention utilizes the high pressure water as part of the metered water that is continuously fed to the mixer, with the balance of the water being fed through low pressure nozzles.

7 Claims, 3 Drawing Sheets

APPARATUS FOR MIXING CALCINED GYPSUM AND ITS METHOD OF OPERATION

FIELD OF INVENTION

This invention relates to a method and apparatus for mixing calcined gypsum (calcium sulfate hemihydrate and/or anhydrite sometimes referred to as stucco). In particular, the invention relates to a mixer employing high pressure water to eliminate or substantially reduce the problem of lumps of gypsum forming inside the mixer and either plugging the mixer or being discharged and causing paper breaks when the calcined gypsum slurry containing the lumps is used to form the gypsum core in a gypsum wallboard product.

BACKGROUND

In mixing calcined gypsum, particularly for use in the manufacture of wallboard, it is important that the calcined gypsum, which forms the core, be mixed so as to obtain a wallboard product in which the gypsum core is relatively lightweight. The core is comprised principally of set gypsum which has been prepared and mixed with a metered amount of water and other additives such as fibers and surfactants whereby the resultant gypsum core is of a porous or cellular structure to obtain a wallboard product which is relatively lightweight in accordance with industry practices. When the calcined gypsum slurry exits the mixer containing lumps of gypsum and the slurry is fed to a board machine for introduction between paper cover sheets, the lumps of gypsum cause the paper sheets to break which requires stoppage of the board machine to remove the broken paper sheets and/or cleanup the gypsum slurry which may spill onto the board machine through the broken sheets.

The problem of lump formation in the mixer is a long standing problem which has not been completely solved through the many years of gypsum wallboard manufacture. As disclosed in U.S. Pat. No. 2,660,416, a mixer having a self-cleaning discharge gate was developed, and in addition, scrapers were used for continuously scraping certain surfaces upon which the gypsum material would ordinarily build up. This was intended to prevent sufficient build up of material to form large lumps which if supplied to the board forming machine would cause defective boards. However, this was a continuing problem for not all of the surfaces in the mixer upon which material could build up were capable of being scraped.

U.S. Pat. No. 2,805,051 also discusses the problem of "set" plaster clinging to the walls of the mixing vessel, mixing blades and any other surfaces which it contacts, forming a hard, solid mass which clogs and otherwise obstructs the operation of the equipment.

The mixer of this invention is what is termed a "continuous mixer", i.e. one in which the ingredients are continuously fed in measured quantities and in proper proportion. The various ingredients are continuously mixed and issue continuously from the mixer as a calcined gypsum or stucco slurry for introduction between the paper cover sheets on a wallboard forming machine.

In contrast thereto, U.S. Pat. No. 4,194,925 discloses a method and apparatus for washing mixing containers with high pressure water. However, the mixing process disclosed in this patent is a batch operation wherein the washing occurs subsequent to the mixing process.

The prior art, e.g. U.S. Pat. No. 5,683,635, also teaches the use of a device in the mixer sometimes referred to as a "lump ring". It aids the mixing action in the mixer and is intended to prevent lumps of gypsum from being discharged from the mixer with the calcined gypsum slurry. The lump ring consists of two rings, one stationary and the other rotating, with a small gap (one eighth to one quarter inch) to prevent lumps from passing to the discharge gate. However, in an EHRSAM mixer, the rotating mixer teeth are external to the lump ring, and it has been discovered that lumps of gypsum form in the junction of the mixer teeth and the rotor body. These lumps are frequently dislodged into the calcined gypsum slurry causing subsequent paper cover sheet breakage.

As previously disclosed, the mixer of this invention is a continuous mixer wherein an effective proportion of water to dry calcined gypsum has been determined and a metered amount of water is fed to the mixer. In a conventional mixer, a series of low pressure water jets are used to incorporate the metered amount of water into the calcined gypsum in the mixer. In accordance with this invention, a portion of the metered water is diverted from the line leading to the low pressure water jets and is passed through a pressure washer pump or other pressurizing device to form high pressurized water. This high pressure water is fed to one or more nozzles which are directed to clean the surfaces in the mixer where material builds up to form lumps. In particular, at least one high pressure nozzle directs a spray of water at the juncture of the teeth and the rotor body. A second high pressure nozzle may also direct a spray of water against the surface of the rotating lump ring.

It is an object of this invention to provide an apparatus for mixing calcined gypsum wherein the formation of lumps of gypsum is substantially reduced by spraying high pressure water against surfaces where lumps of gypsum can form.

It is another object of this invention to provide an apparatus for mixing calcined gypsum wherein high pressure water is sprayed against the juncture of the rotor teeth and the rotor body.

It is a further object of this invention to provide an apparatus for mixing calcined gypsum having two high pressure water nozzles, with one nozzle directing a spray of water against the juncture of the rotor teeth and the rotor body and the other nozzle directing a spray of water against the rotating lump ring.

It is still another object of this invention to provide a method for operating an apparatus for continuously mixing calcined gypsum wherein a metered amount of water is incorporated into the calcined gypsum through both low pressure nozzles and at least one high pressure nozzle.

These additional objects and advantages of this invention will be readily understood from a consideration of the drawings and the following detailed description of the preferred embodiment.

BRIEF DESCRIPTION OF THE DRAWINGS

In the description of the preferred embodiments of the invention presented below, reference is made to the accompanying drawings, in which.

DESCRIPTION OF PREFERRED EMBODIMENTS

This invention relates to apparatus for mixing calcined gypsum as employed in the prior art practice of preparing a calcined gypsum slurry and discharging the slurry between paper cover sheets on a wallboard forming machine. As previously noted, this apparatus is a continuous mixer. The drawings, to be discussed hereinafter, represent an EHR-SAM mixer, however, mixers made by other manufacturers may employ the means and methods of this invention. The principal difference in the method and apparatus of this invention and the methods and apparatus of the prior art is the employment of high pressure water to preclude or reduce the formation of lumps of gypsum and thereby eliminate or substantially reduce paper breakage on the board forming machine.

The prior art mixers typically use a series of low pressure water jets or nozzles to incorporate the water into the mixer to form the calcined gypsum slurry. These low pressure water jets supply water at a pressure on the order of 40 psi. In contrast thereto, the high pressure jets employed in carrying out this invention supply water at a pressure on the order of at least about 400 psi. In general, the pressure in the high pressure jets ranges from about 400 psi to about 800 psi.

Another important factor is the location of the high pressure jets. It has been discovered that lumps of gypsum form at the juncture of the rotor teeth and the rotor body. Periodically, these lumps are dislodged into the calcined gypsum slurry causing breakage of the paper cover sheets on the board machine. In accordance with this invention, the high pressure water jets direct the spray of high pressure water at the juncture of the rotor teeth and the rotor body which prevents or substantially reduces the formation of the lumps of gypsum. One of the novel aspects of this invention is that the high pressure water is part of the metered water that is continuously fed to the mixer with the balance of the water being fed through the low pressure nozzles. As a result, the mixer can be operated continuously with no downtime for cleaning the rotor teeth and the other surfaces.

In addition to the high pressure water jets, it is generally preferred to employ a lump ring as well known in the prior art. It has also been found advantageous to provide a second high pressure water jet with the water being directed at the surface of the rotating lump ring in the gap between the rotating ring and the stationary ring. As previously noted, this gap generally ranges from about one eighth to one quarter inch.

For a description of a preferred embodiment of the invention, reference is made to the drawings which illustrate an apparatus in accordance with the invention.

Figure 1:
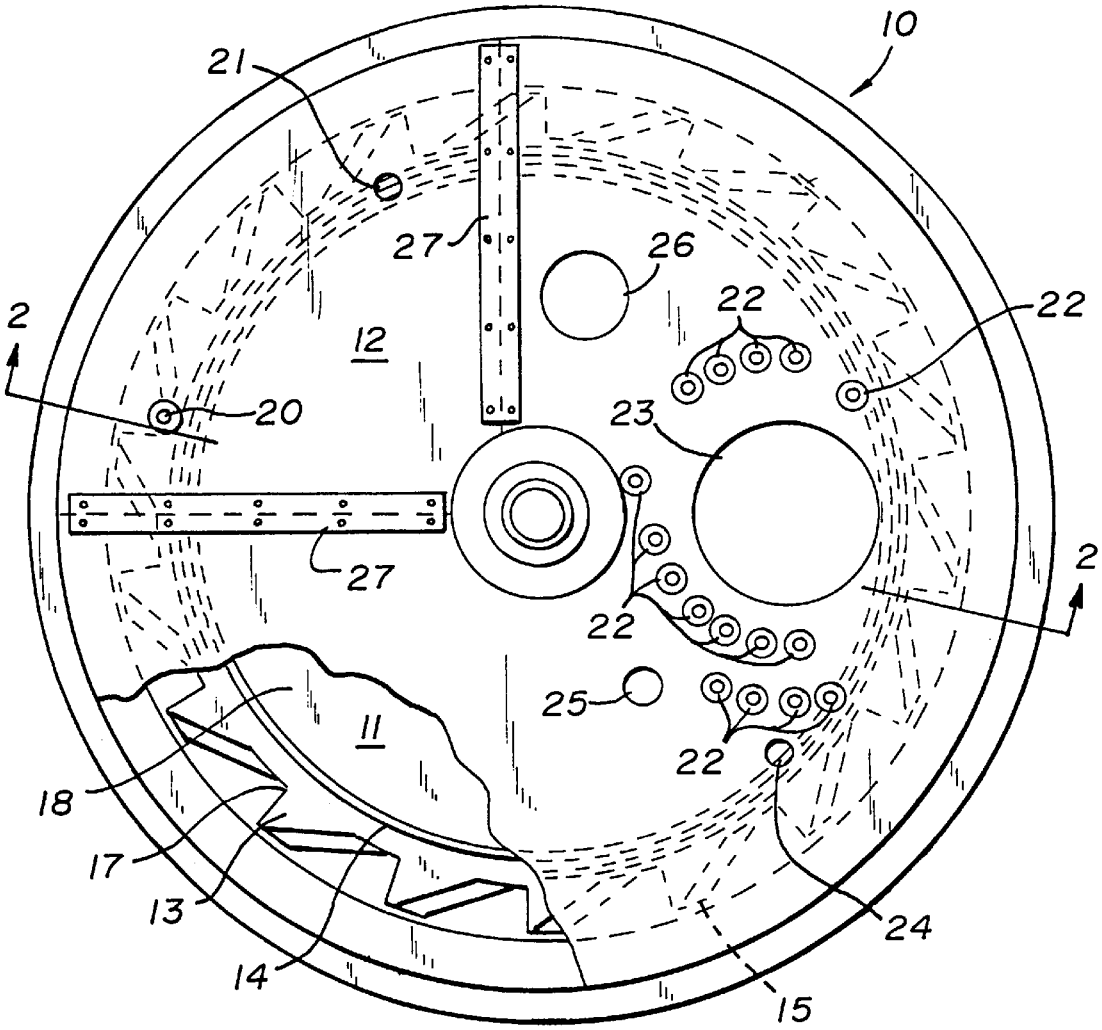
FIG. 1 is a top view of the mixer apparatus of this invention with a portion of the cover broken away to illustrate the rotor teeth and the rotating lump ring.
Figure 2:
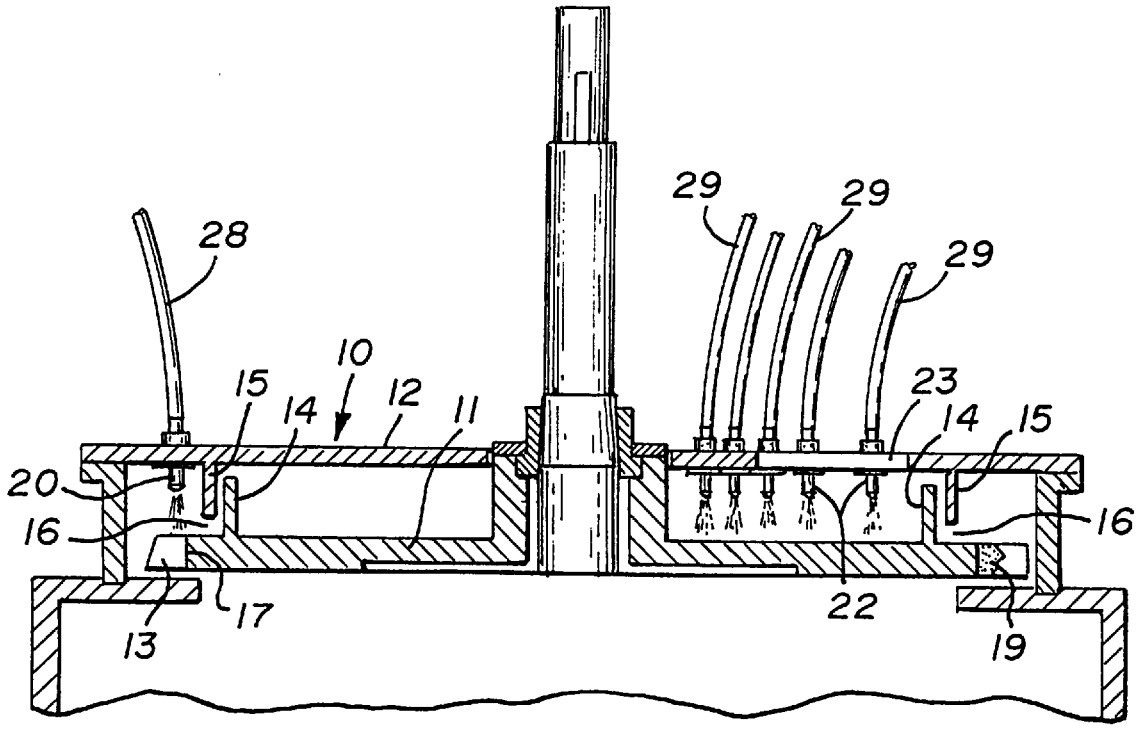
FIG. 2 is a cross-sectioned view of the mixer apparatus taken along line 2-2 of FIG. 1.

FIG. 1 illustrates the top of the mixer (10). The mixer rotor (11) is seen in full view where the portion of the top cover (12) is broken away. The rotor teeth (13) are also seen in full view where the portion of the top cover (12) is broken away. Also visible in this portion is the rotating lump ring (14) attached to the rotor (11). The stationary lump ring (15) attached to the top cover (12) is seen in FIG. 2. The gap (16) between the rotating and stationary rings ranges form about one eighth inch to about one quarter inch and is also seen in FIG. 2.

The juncture (17) between the rotor teeth (13) and the rotor body (18) is the critical area where lumps (19) of gypsum may form. The high pressure water jet (20) located in the top cover (12) must be located so as to be aligned with the juncture (17). This is clearly visible in FIGS. 1 and 2, although in FIG. 1, the rotor teeth (13) are illustrated in dashed lines under the top cover (12). In a preferred embodiment, there is a second high pressure water jet (21) located in the top cover (12) in direct alignment over the gap (16) between the rotating and stationary lump rings.

Also see in FIGS. 1 and 2 are the low pressure water jets (22). These low pressure water jets (22) generally surround the entry port or inlet (23) where the calcined gypsum and possibly other dry ingredients are fed to the mixer (10). In addition, inlet (24) is provided for adding surfactant to the calcined gypsum slurry, and inlet (25) is provided for adding foam and emergency water if necessary. A vent (26) is also provided in the top cover (12) to control the pressure in the mixer (10). Also shown in FIG. 1 are metallic pieces (27) used to connect the segments (900 radial sections) of the top cover (12).

As previously stated, the apparatus for mixing calcined gypsum is a continuous mixer using a metered amount of water, depending on the amount of calcined gypsum and other additives and the desired consistency of the calcined gypsum slurry to be fed to the board forming machine. The metered amount of water is apportioned between the high pressure jet or jets and the low pressure jets. In the EHR-SAM mixer illustrated in the drawings, a portion of the water is diverted off the gauging water line to a line and passed to a pressure washer pump (not shown). The pump may be powered by a 1½ HP motor, although as an alternative, a gear pump could be used for longer life and greater volumes of water. It has been found that the volume of water should be at least about 2 gallons per minute. The pressure should be at least about 400 psi to produce enough force to wash the areas clean. After pressurizing the water, it is fed through a line (28) as shown in FIG. 2 to a fan style, stainless steel spray nozzle (20), positioned over the mixer teeth. In addition, it is preferred to have a second high pressure spray nozzle (21) positioned in the top cover (12) to clean the rotating lump ring (14). Water lines (29) carry the water to the low pressure jets (22).

Figure 3:
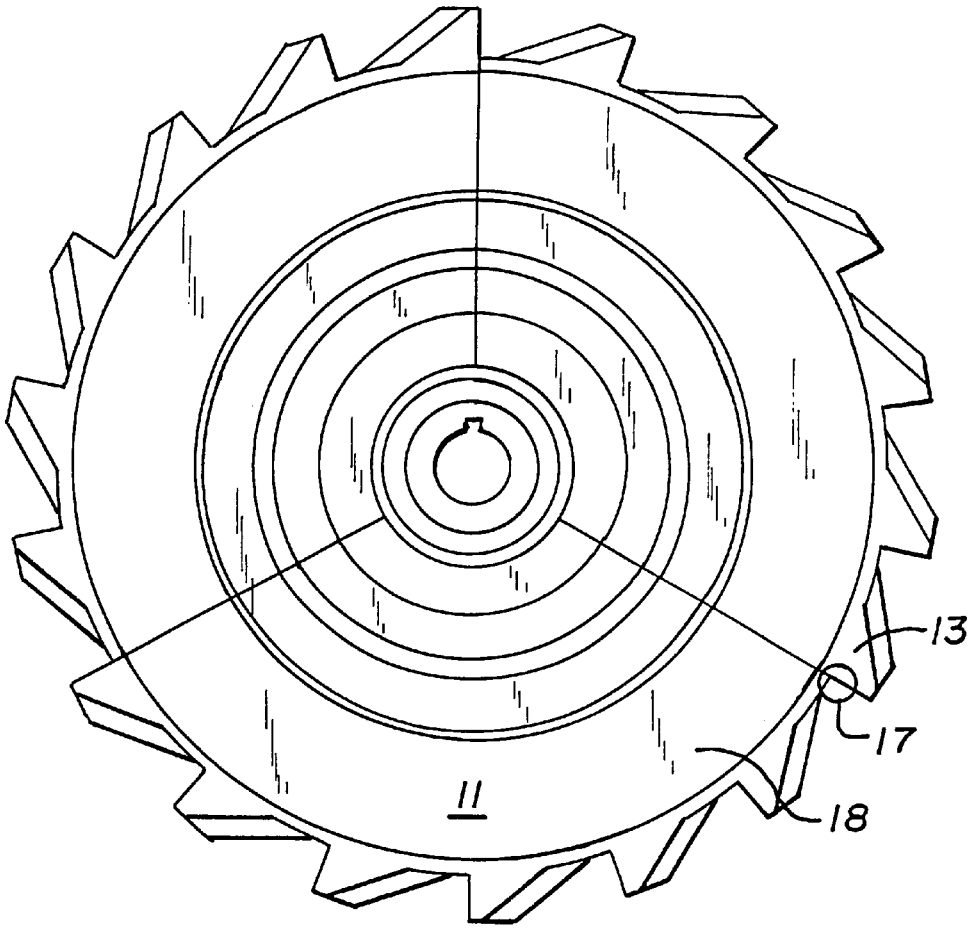
FIG. 3 is a top view of the rotor of the mixer apparatus of this invention.

FIG. 3 illustrates the mixer rotor (11). The juncture (17) between the rotor teeth (13) and the rotor body (18) is the critical area to which the high pressure water is applied. Since installation of the high pressure jet (20), lumps of gypsum formed in the mixer (10) have been substantially reduced. As shown in FIG. 3, the mixer rotor (11) comprises 3 identical segments.

Figure 4:
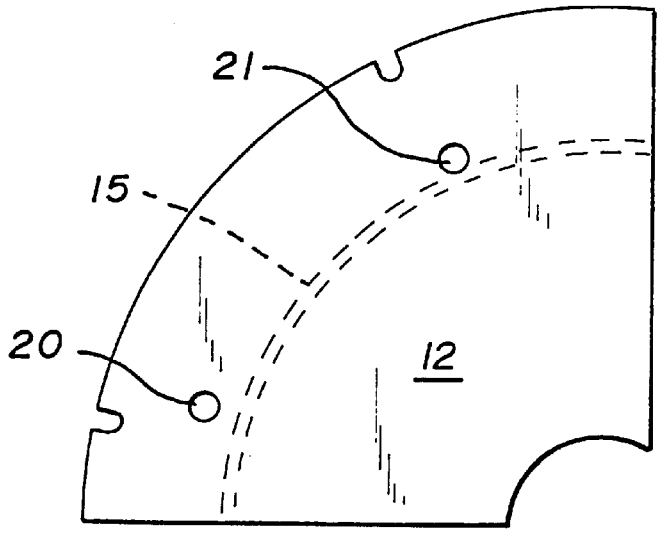
FIG. 4 is a top view of a segment of the cover of the mixer apparatus of this invention showing the location of the high pressure water jet nozzles.

FIG. 4 illustrates a quartile segment of the mixer top cover (12). It shows the location of the high pressure water jets (20) and (21). It also specifically locates the stationary lump ring (15) which is attached to the underside of the top cover (12).

This invention has been described in detail, with particular reference to preferred embodiments, but it should be appreciated that variations and modifications can be effected within the scope of the invention.

What is claimed is:

1. Apparatus for mixing calcined gypsum comprising a top cover and a disk-shaped rotor comprising a rotor body with teeth along the periphery for mixing calcined gypsum with a metered amount of water and other ingredients to form a gypsum slurry, wherein the top cover contains a plurality of low pressure water jets and at least one high pressure water jet, with said high pressure water jet being aligned perpendicularly over the juncture of the rotor teeth and the rotor body, such that a vertical line defined by the high pressure jet and the juncture is perpendicular to a horizontal plane defined by the surface of the disk-shaped rotor, with a portion of the metered water introduced into the apparatus through the high pressure jet and the balance of the water is introduced into the apparatus through the low pressure jets, whereby the formation of lumps of gypsum at said juncture is substantially reduced.

2. The apparatus of claim 1 wherein there is a lump ring in the apparatus, said ring comprising a stationary metallic ring attached to the underside of the top cover and a rotating metallic lump ring attached to the disk-shaped rotor with a gap between the stationary and rotating lump rings ranging from about one eighth inch to about one quarter inch.

3. The apparatus of claim 2 wherein there is a second high pressure water jet located in the top cover and positioned therein in direct, vertical alignment over the gap such that water sprayed through this jet impinges upon the rotating lump ring in the area of the gap between the stationary and the rotating rings.

4. The method of operating the apparatus of claim 1 wherein a portion of the water is introduced into the apparatus through the high pressure water jet in the top cover with the water pressure in said high pressure water jet ranging from about 400 psi to about 800 psi, and the balance of the water is introduced into the apparatus through a plurality of low pressure water jets in the top cover.

5. The method of claim 4 wherein the water pressure in the low pressure water jets is about 40 psi.

6. The method of claim 4 wherein the water introduced into the apparatus through the high pressure water jet is directed to impinge upon the periphery of the disk-shaped rotor at the juncture of the teeth on the rotor and the rotor body.

7. The method of claim 4 wherein there is a second high pressure water jet in the top cover and there is a rotating lump ring attached to the disk-shaped rotor near the periphery thereof, with the water pressure in both high pressure water jets ranging from about 400 psi to about 800 psi, and the water sprayed through the second high pressure water jet is directed toward and impinges upon said rotating lump ring.

* * * * *